US006260533B1

(12) United States Patent
Tanaka

(10) Patent No.: US 6,260,533 B1
(45) Date of Patent: Jul. 17, 2001

(54) OIL PASSAGEWAY STRUCTURE FOR INTERNAL COMBUSTION ENGINE

(75) Inventor: Ryuji Tanaka, Shizuoka-ken (JP)

(73) Assignee: Suzuki Motor Corporation, Shizuoka-ken (JP)

( * ) Notice: Subject to any disclaimer, the term of this patent is extended or adjusted under 35 U.S.C. 154(b) by 0 days.

(21) Appl. No.: 09/298,707

(22) Filed: Apr. 23, 1999

(30) Foreign Application Priority Data

Apr. 30, 1998 (JP) ..... 10-136079

(51) Int. Cl.[7] ..... F01M 1/00
(52) U.S. Cl. ..... 123/196 R; 123/196 M
(58) Field of Search ..... 123/196 M, 196 R

(56) References Cited

U.S. PATENT DOCUMENTS 4,702,204 * 10/1987 Anno et al. ..... 123/196 R
5,094,201 * 3/1992 Bedi ..... 123/196 R
5,666,915 * 9/1997 Kawashima et al. ..... 123/196 R
5,950,763 * 9/1999 Ohta ..... 123/196 R
6,000,373 * 12/1999 Woodhouse ..... 123/196 M
6,016,784 * 1/2000 Tanaka ..... 123/196 R

FOREIGN PATENT DOCUMENTS 62-179314 11/1987 (JP) .
5-6112 1/1993 (JP) .
08028231 1/1996 (JP) .
08232625 9/1996 (JP) .
091704150 6/1997 (JP) .

* cited by examiner

*Primary Examiner*—John Kwon
(74) *Attorney, Agent, or Firm*—Flynn, Thiel, Boutell & Tanis, P.C.

(57) ABSTRACT

An oil passageway structure for an internal combustion engine which provides a greater degree of freedom in design, prevents oil leakage outside the engine, and avoids the need to change the respective shapes of a cylinder block and a cylinder head, with a concomitant reduction in plant investment. The oil passageway structure includes an oil pipe laid between a passage extending on the downstream side of an oil pump on the side of the cylinder block and an oil control valve on the side of the cylinder head. The oil pipe is positioned inside a chain chamber.

13 Claims, 9 Drawing Sheets

OIL PASSAGEWAY STRUCTURE FOR INTERNAL COMBUSTION ENGINE

FIELD OF THE INVENTION

This invention relates to an oil passageway structure for an internal combustion engine and, more particularly, to an oil passageway structure for introducing oil to an oil control valve for actuating hydraulic equipment.

BACKGROUND OF THE INVENTION

Some internal combustion engines include a crankshaft rotatably supported on a cylinder block, a crank timing sprocket positioned on the crankshaft, and a camshaft rotatably carried on a cylinder head for opening and closing intake and exhaust valves, which cylinder head is disposed on the cylinder block. Also included is a cam sprocket positioned on the camshaft, a timing chain wrapped around the crank timing sprocket and the cam sprocket, an enclosing member extending over the cylinder block and the cylinder head so as to cover the timing chain to form a chain chamber, and an oil pump disposed on the crankshaft on the side of the cylinder block.

In recent years, in some internal combustion engines, a variable valve timing system is provided for varying the valve timing of intake and exhaust valves in order to enhance a variety of required functions.

As illustrated in FIG. 11, the variable valve timing system is provided with: an oil pump 204 and a crank shaft timing sprocket 206, both disposed on a crankshaft 202; intake and exhaust camshaft sprockets 212, 214 disposed on intake and exhaust camshafts 208, 210, respectively; a timing chain 216 wound around the crankshaft timing sprocket 206 and the camshaft sprockets 212, 214; a hydraulic actuator 218 provided as hydraulic equipment at an end portion of the intake camshaft 208; an oil control valve 220 positioned in a cylinder head (not shown) for actuating the hydraulic actuator 218; and, control means such as an electronic control unit (ECU) 222 (shown schematically) for actuating the oil control valve 220. The control means 222 communicates with a crank angle sensor 224 and a cam angle sensor 226 via electrical signals (shown in dotted lines in FIG. 11) to calculate optimum valve timing in accordance with a running state of an internal combustion engine (not shown). The control means 222 actuates (via an electrical signal) the oil control valve 220 so as to control hydraulic pressure on the hydraulic actuator 218, thereby varying respective phases of the intake camshaft 208 and the crankshaft 202.

As illustrated in FIG. 12, in order to introduce oil from the oil pump 204 on the cylinder block side to the oil control valve 220 on the cylinder head side, an oil pipe 228 is mounted in the following manner: a pipe connection member 230 at one end of the oil pipe 228 is mounted on a cylinder block 234 by means of a union bolt 232; and a pipe connection member 236 at the other end of the oil pipe 228 is mounted on an intake camshaft cap 240 by means of an additional union bolt 238. The intake camshaft cap 240 retains the intake camshaft 208. The oil pipe 228 is exposed and laid outside the engine.

Examples of such an oil passageway structure are disclosed in, for example, published Japanese Utility Model Application Laid-Open No. 5-6112, Japanese Patent Application Laid-open No. 8-232625, Japanese Patent Application Laid-Open No. 8-28231, Japanese Patent Application Laid-Open No. 9-170415, and Japanese Utility Model Application Laid-Open No. 62-179314. According to Japanese Utility Model Application No. 5-6112, a chain cover, i.e., an enclosing member, is formed with an oil passage in an internal combustion engine which has the oil pump positioned at a lower portion of the cylinder block. According to Japanese Patent Application No. 8-232625, a plurality of linear communication pipes are connected to an oil gallery in a crank case. Pursuant to Japanese Patent Application No. 8-28231, a hydraulic control valve, i.e., an oil control valve, is provided in a dead space of the cylinder block. According to Japanese Patent Application No. 9-170415, the cylinder head is formed with the oil passage in an internal combustion engine having variable valve timing. Pursuant to Japanese Utility Model Application No. 62-179314, a lubricating oil pipe is laid or disposed in the crank case.

In the past, with the internal combustion engine having the variable valve timing system, an inconvenience occurs when an oil pipe is laid outside the engine. This oil pipe extends from a main gallery as an oil passageway system which leads to the oil control valve. The main gallery is formed in the cylinder block. The inconvenience is that, if oil seeps from the oil pipe, then the oil escapes to the outside environment because the oil pipe is laid outside of the engine. Further inconveniences arise when oil passages are formed in the cylinder block and the cylinder head by drilling holes therein for the sole purpose of passage of oil. More specifically, the necessity of such dedicated holes involves dedicated fabrication facilities as well as a dedicated cylinder block and a dedicated cylinder head. In addition, such dedicated holes result in a reduced amount of freedom in design. Further, since the cylinder block is fabricated by dedicated machines, fabrication lines must be modified when the quantity of dedicated holes is to be increased or changes to the holes are desired. As a result, plant investment is increased.

SUMMARY OF THE INVENTION

In order to minimize or obviate the above-mentioned inconveniences, the present invention provides an oil passageway structure for an internal combustion engine having a crankshaft rotatably supported on a cylinder block of the engine, a crankshaft timing sprocket positioned on the crankshaft, a camshaft rotatably carried on a cylinder head for opening and closing intake and exhaust valves, the cylinder head being disposed on the cylinder block, a camshaft sprocket positioned on the camshaft, a timing chain wound around the crankshaft timing sprocket and the camshaft sprocket, and an enclosing member extending over the cylinder block and the cylinder head so as to cover the timing chain to form a chain chamber. An oil pump is provided on the side of the cylinder block, and an oil control valve is disposed on the side of the cylinder head for actuating hydraulic equipment, whereby oil from the oil pump is introduced into the oil control valve. The oil passageway structure according to the invention includes an oil pipe extending between a passage extending on a downstream side of the oil pump and the oil control valve, the oil pipe being provided inside the chain chamber.

Pursuant to the present invention, the oil pipe located inside the chain chamber is provided between the passage extending on the downstream side of the oil pump and the oil control valve. Further, the oil pipe can be bent when desired. As a result, there is provided a greater degree of freedom in design. In addition, there is no need to change respective shapes of the cylinder block and the cylinder head. Consequently, fabrication facilities or fabrication lines need not be modified, with a noncomitant reduction in plant investment. Moreover, oil can be prevented from escaping outside the engine, even if oil leaks from locations where the oil pipe is mounted. Further, since the oil pipe is mounted unitarily on the enclosing member, then sub assembly is achievable, with a consequential improvement in efficiency of assembly.

BRIEF DESCRIPTION OF THE DRAWINGS

Embodiments of the present invention will now be described in specific detail with reference to the drawings, in which.

DETAILED DESCRIPTION

Figure 1:
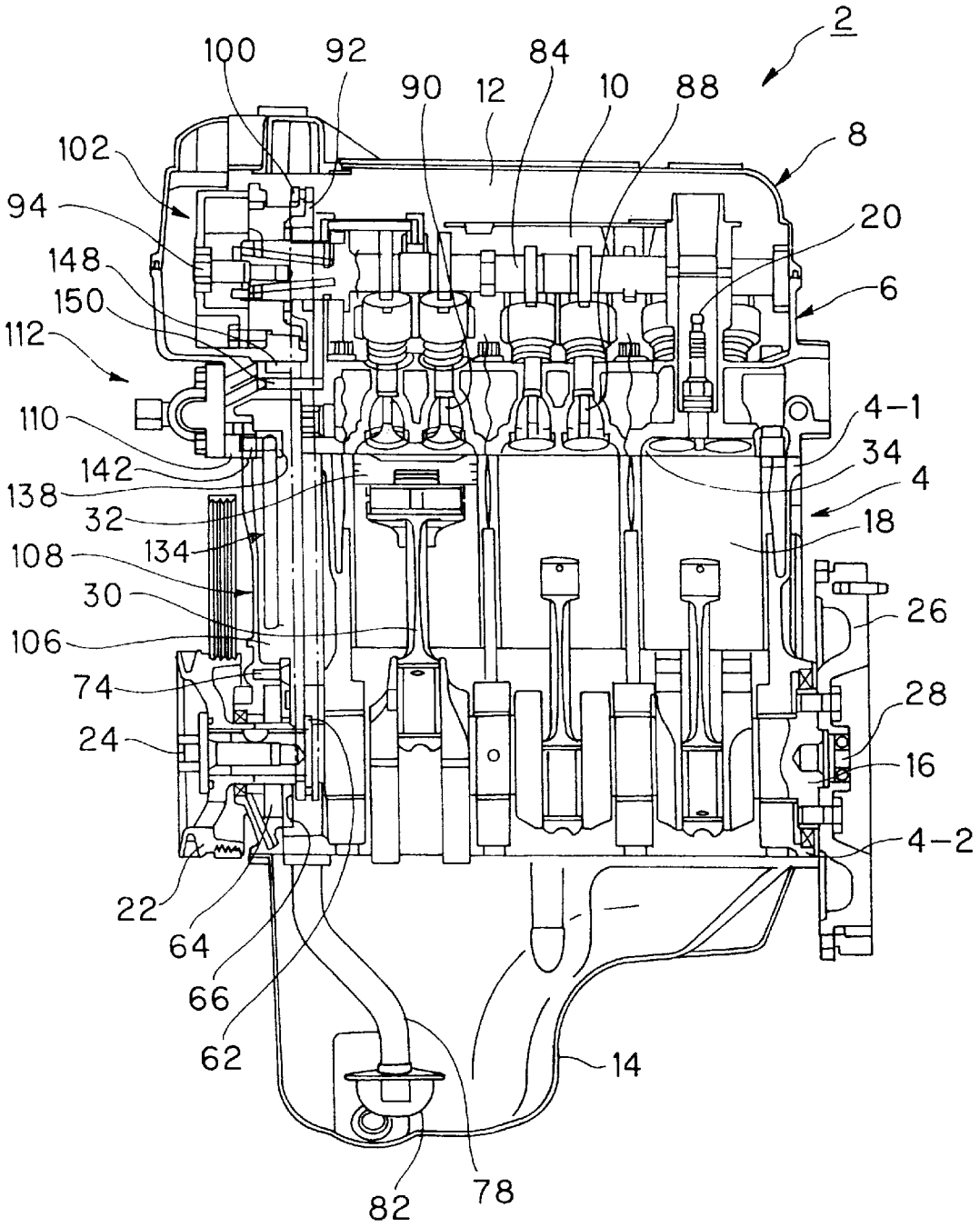
FIG. 1 is a cross-sectional view showing an internal combustion engine.

FIGS. 1–9 illustrate a first embodiment. In FIGS. 1, 2, 8, and 9, reference numeral 2 denotes a multi-cylinder internal combustion engine disposed in a vehicle (not shown); 4 a cylinder block; 6 a cylinder head; 8 a cylinder head cover; 10 a cam chamber; 12 a breather chamber; and 14 an oil pan. The cylinder block 4 includes a first upper cylinder block 4-1 and a second lower cylinder block (lower crank case) 4-2. The upper and lower cylinder blocks 4-1 and 4-2 rotatably support a crankshaft 16.

Figure 2:
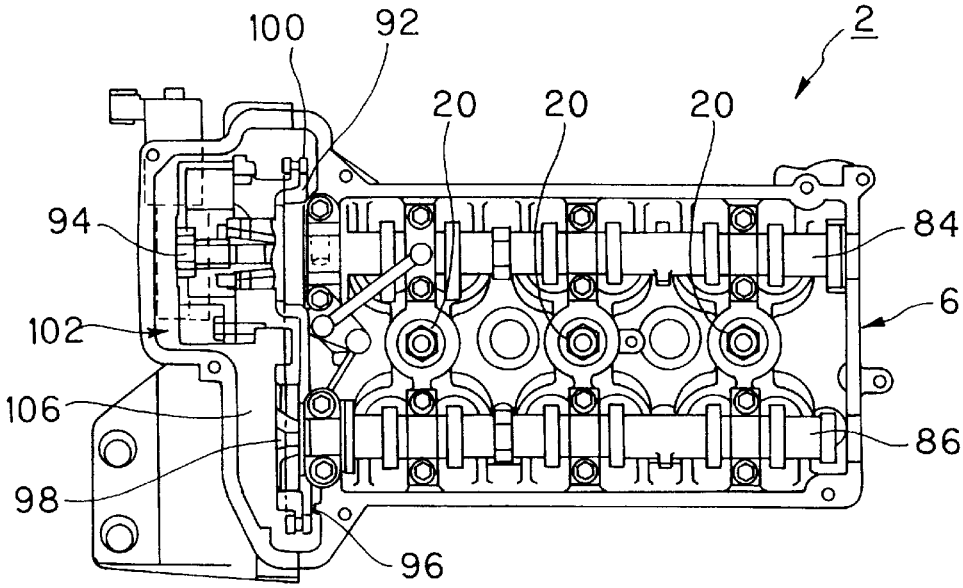
FIG. 2 is a plan view of the engine of FIG. 1.
Figure 3:
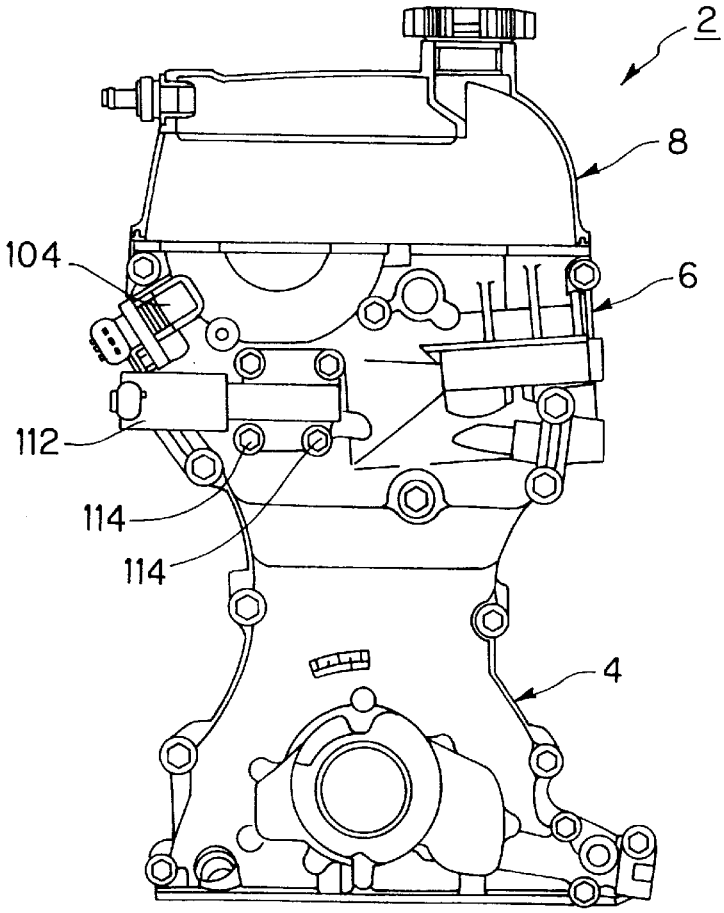
FIG. 3 is a schematic front view of the engine.

Referring to FIGS. 1 and 2, the first cylinder block 4-1 is shown having three cylinders 18 formed in series therein. The cylinder head 6 has an ignition or spark plug 20 fitted therein corresponding to each of the cylinders 18.

The crankshaft 16 has a crank pulley 22 and a flywheel 26 mounted thereon by means of a pulley-mounting bolt 24 and a fly wheel-mounting bolt 28, respectively. The crank pulley 22 and the flywheel 26 are located at opposite ends of the crankshaft 16. The crankshaft 16 also has a proximal end of a connecting rod 30 mounted thereon corresponding to each of the cylinders 18. The connecting rod 30 has a piston 32 mounted on the distal end thereof for reciprocating movement inside the respective cylinder 18.

Figure 8:
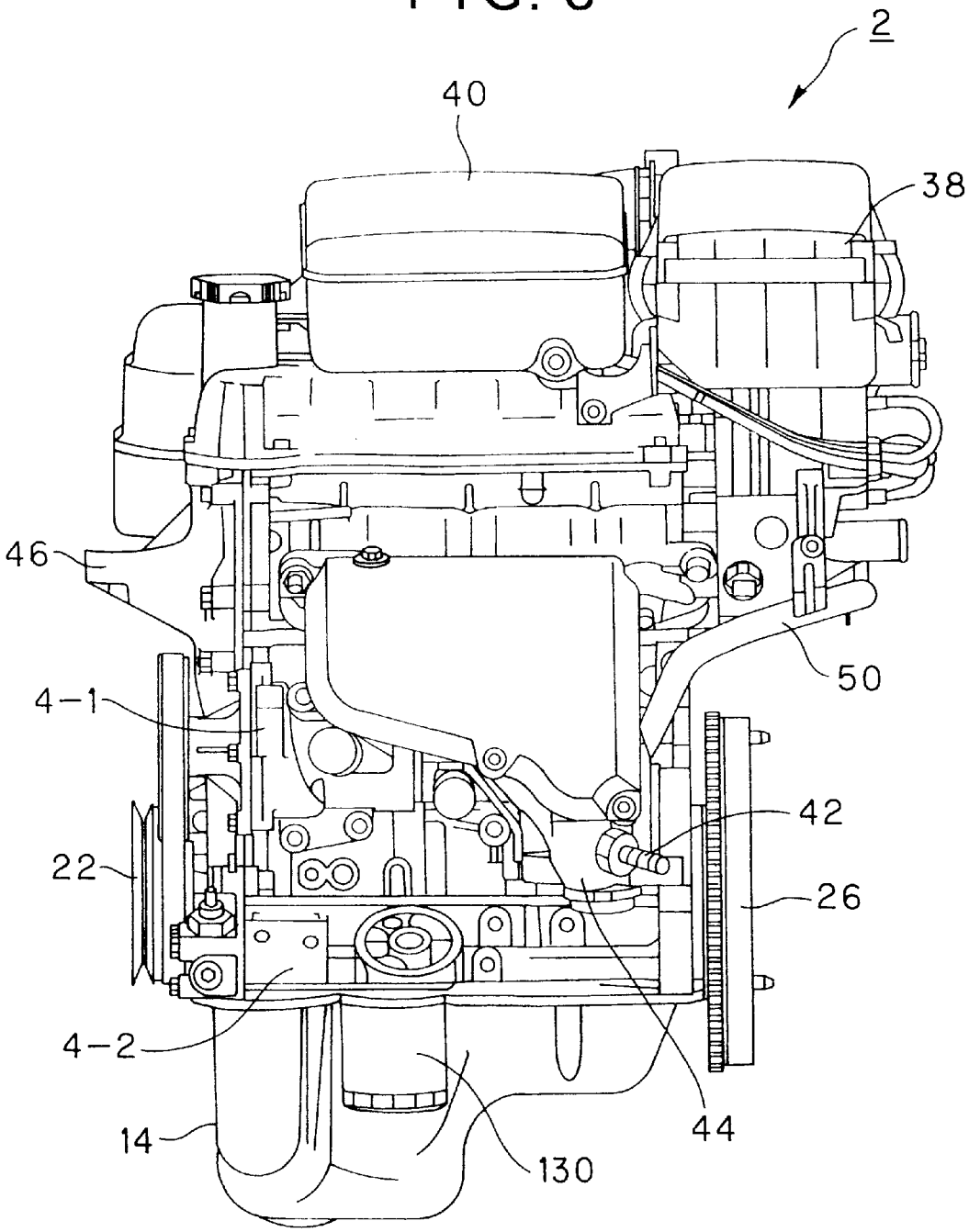
FIG. 8 is a side view of the engine.
Figure 9:
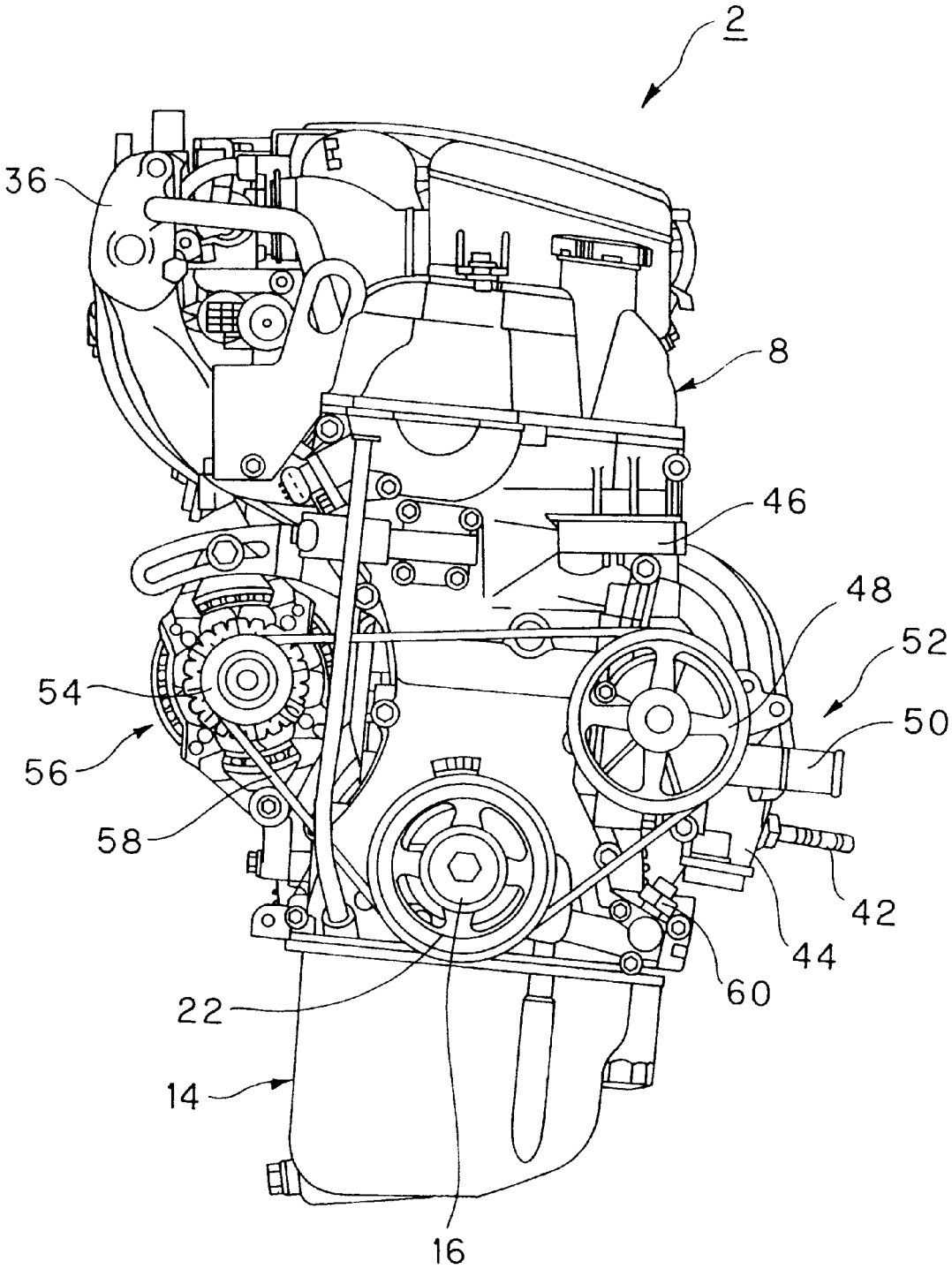
FIG. 9 is a front view of the FIG. 8 engine.

In the cylinder head 6, a combustion chamber 34 is formed above the piston 32 in each of the respective cylinders 18. The cylinder head 6 also includes an intake manifold 36, an air cleaner 38, and an intake resonator 40 (FIGS. 8 and 9). In addition, an exhaust manifold 44 and an engine mount bracket portion 46 are mounted on the cylinder head 6. The exhaust manifold 44 is provided with an oxygen sensor 42.

The cylinder block 4 has a water pump 52 and an alternator 56 mounted thereon. The water pump 52 is provided with a water pump pulley 48 and a cooling pipe 50. The alternator 56 is equipped with an alternator pulley 54. A belt 58 is trained around the crank pulley 22, the water pump pulley 48, and the alternator pulley 54.

The second cylinder block 4-2 has an oil sensor 60 mounted thereon for detecting the temperature or pressure of the engine oil.

A crankshaft timing sprocket 62 and an oil pump 64 are mounted at one end of the crankshaft 16 (FIG. 1).

Figure 5:
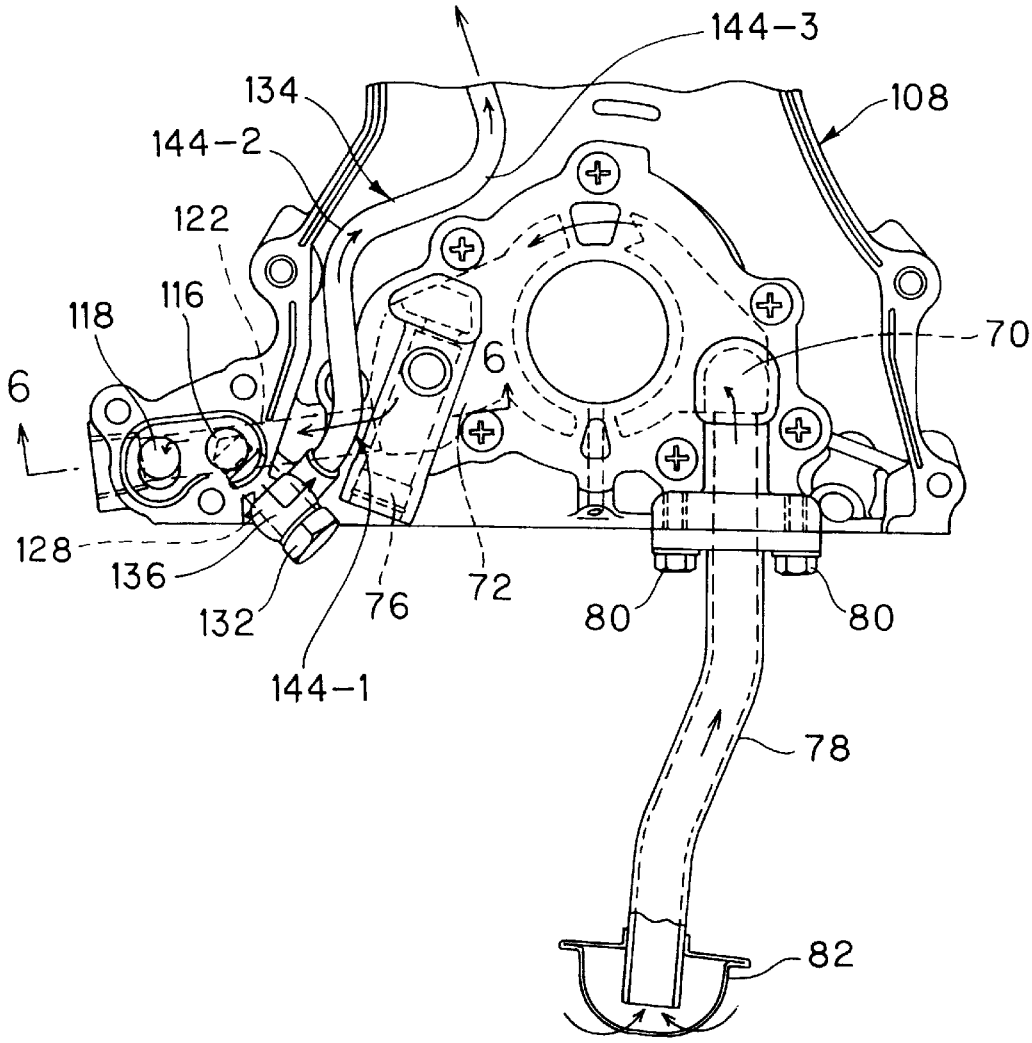
FIG. 5 is an enlarged fragmentary view illustrating a lower portion of FIG. 4.
Figure 6:
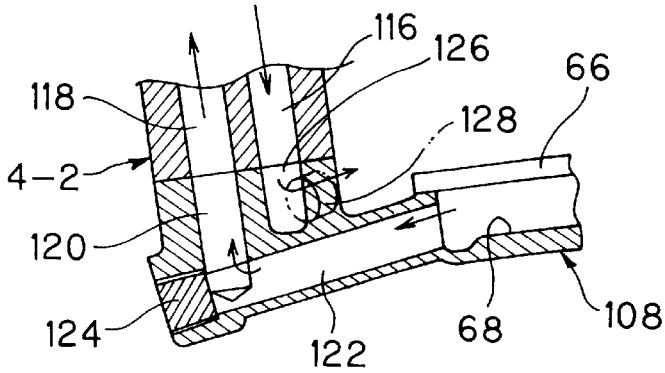
FIG. 6 is an enlarged fragmentary cross-sectional view taken generally along line 6—6 of FIG. 5.

The oil pump 64 is provided with a rotor chamber 68, an intake port 70, and a discharge port 72 by means of a hereinafter-mentioned enclosing or cover member 108 and a pump plate 66 (FIGS. 1, 5 and 6). The enclosing member 108 is located outwardly of the pump plate 66. The pump plate 66 is mounted on an inner surface of the enclosing member 108 by means of a plate-mounting screw 74. The rotor chamber 68 accommodates inner and outer rotors (not shown). A relief valve 76 is mounted on the enclosing member 108 at a location adjacent the discharge port 72.

A proximal end of an intake pipe 78 is mounted in the second cylinder block 4-2 by means of pipe-mounting bolts 80. The proximal end of the intake pipe 78 communicates with the intake port 70. A distal end of the intake pipe 78 is located at the bottom of the oil pan 14. In addition, an oil strainer 82 is provided at the distal end of the intake pipe 78.

Figure 7:
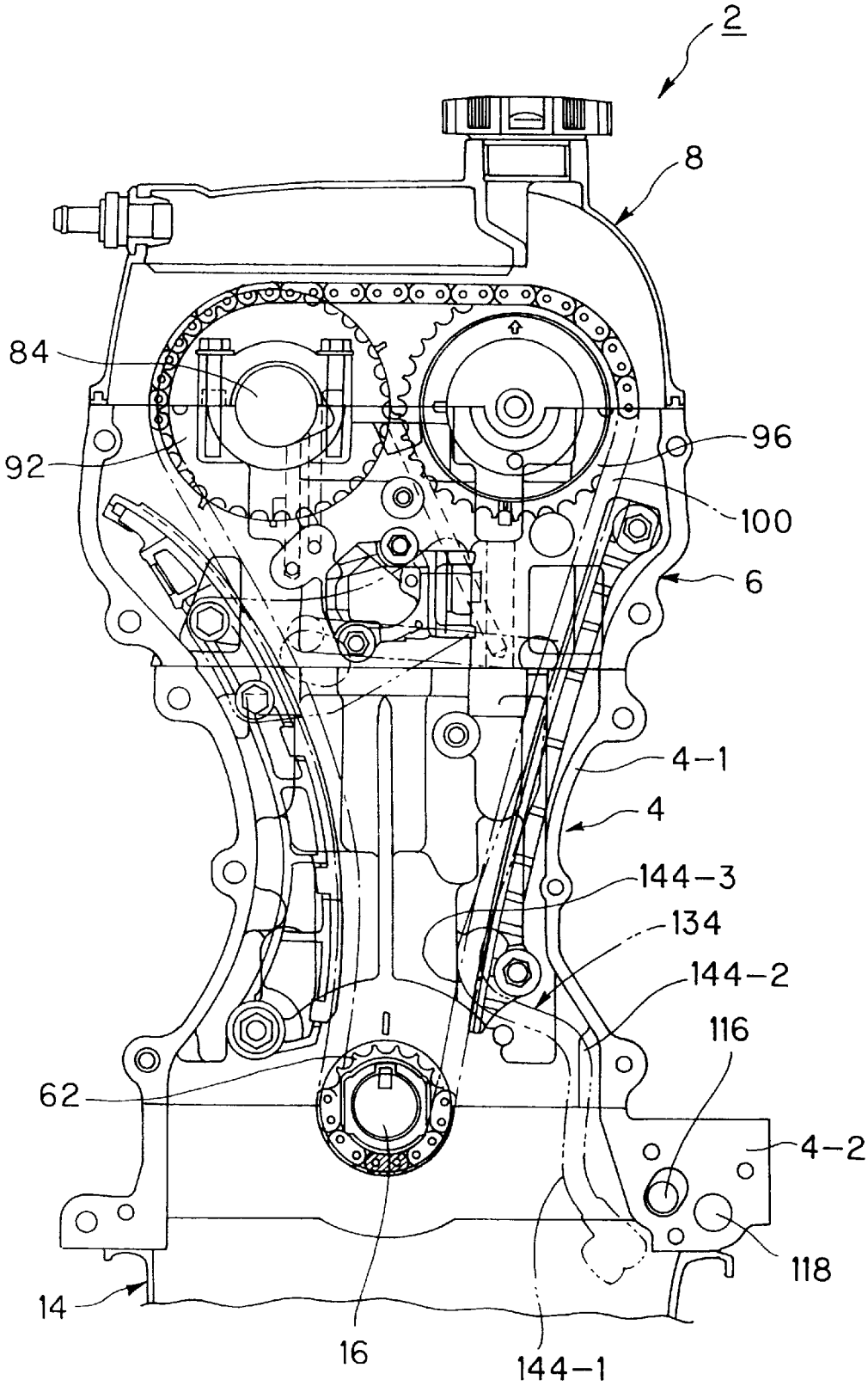
FIG. 7 is an enlarged, fragmentary and sectional front view of the engine.

Intake and exhaust camshafts 84, 86 disposed in parallel with one another are provided at an upper portion of cylinder head 6 and are rotatably supported thereon (FIGS. 1 and 2). The intake camshaft 84 and the exhaust camshaft 86 actuate intake valves 88 and exhaust valves 90, respectively, for opening and closing the combustion chambers 34 of the respective cylinders. 18. An intake camshaft sprocket 92 is mounted on the intake camshaft 84 at one end thereof by means of an intake-side mounting bolt 94. An exhaust camshaft sprocket 96 is mounted on the exhaust camshaft 86 at one end thereof by means of an exhaust-side mounting bolt 98. A timing chain 100 is provided so as to surroundingly engage the crankshaft timing sprocket 62, the intake camshaft sprocket 92, and the exhaust camshaft sprocket 96 (FIG. 7).

Further, hydraulic equipment (i.e. a hydraulic actuator) 102 for a variable valve timing system (for varying valve timing of the intake and exhaust valves 88 and 90) is mounted on the intake camshaft 84 by means of the intake-side mounting bolt 94.

In the cylinder head 6, a crank angle sensor 104 is mounted for detecting a crank angle, i.e. the rotation of the intake camshaft sprocket 92.

The cover or enclosing member 108 is mounted and spread over the cylinder-block 4 and the cylinder head 6 so as to cover the timing chain 100 to form a chain chamber 106 (FIG. 2). The enclosing member 108 in the illustrated embodiment is made of an aluminum material. The enclosing member 108 is formed as either a chain cover or an oil pump case. The cylinder head cover 8 is disposed on an upper surface of the enclosing member 108.

The enclosing member 108 has an oil control valve 112 provided on a valve-mounting boss 110 by means of valve-mounting bolts 114. The valve-mounting boss 110 is located at approximately the same elevation as the cylinder head 6. The oil control valve 112 is operated by control means (not shown) to control hydraulic pressure on the hydraulic actuator 102 so as to adjust valve timing.

Figure 4:
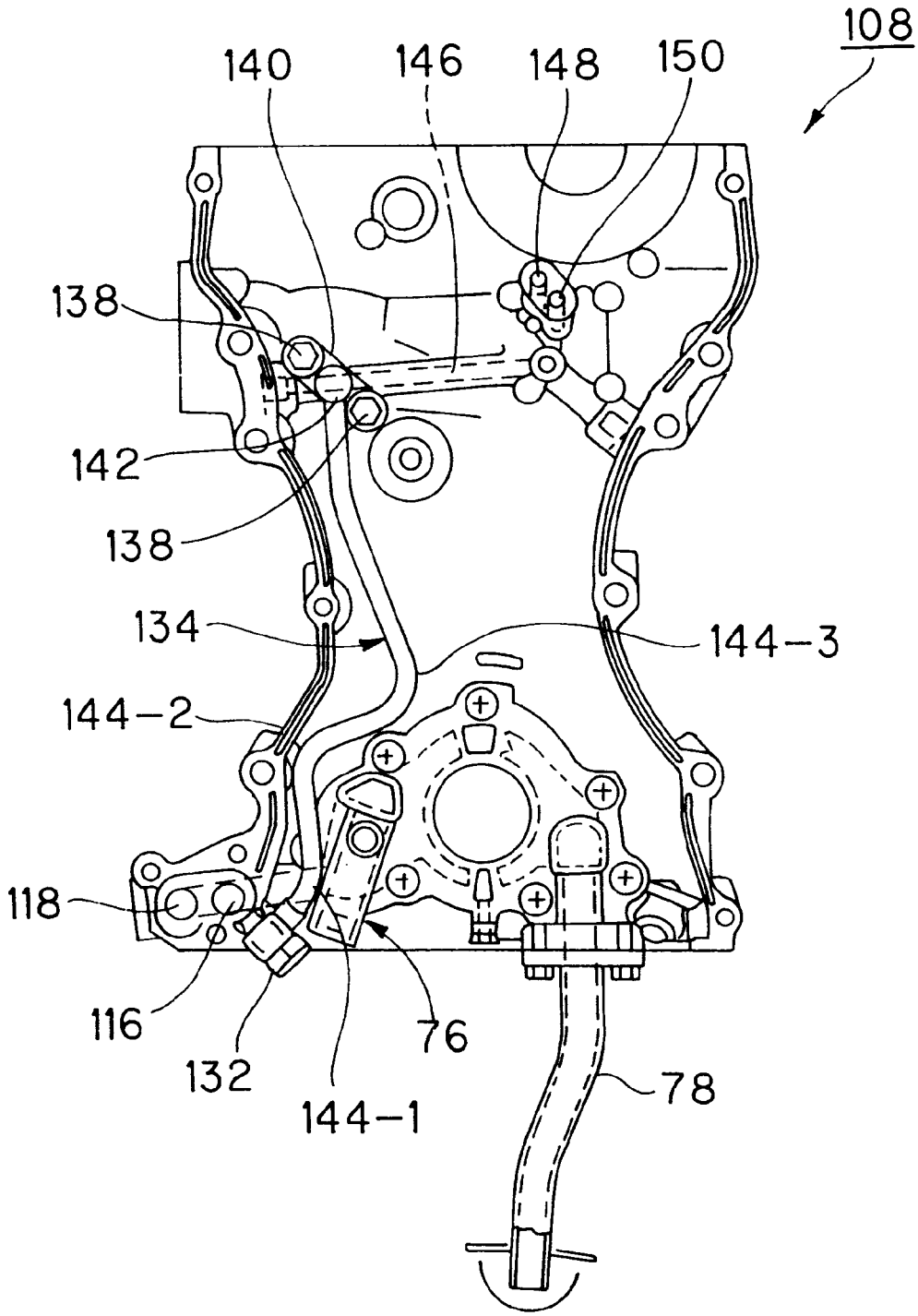
FIG. 4 shows an enclosing member as viewed from the inside.

Referring now to FIGS. 4–6, a main gallery 116 and a sub-gallery 118 are defined in the second cylinder block 4-2.

The main and sub-galleries 116 and 118 are oriented in the axial direction of the crankshaft 16.

The sub-gallery 118 is positioned outwardly of the main gallery 116; and is thus spaced apart from the oil pump 64 (and crankshaft 16) by a greater distance as compared to main gallery 116. The sub-gallery 118 communicates with first and second sub-gallery communication holes 120 and 122. The holes 120 and 122 are formed in the enclosing member 108 as respective passages on the downstream side of the oil pump 64. The first hole 120 is oriented in the axial direction of the crankshaft 16. The second hole 122 communicates with the first hole 120, and extends in a direction generally perpendicular to the crankshaft 16. The second hole 122 is closed at one end by a blind tap 124, and at the other end communicates with the discharge port 72 of oil pump 64 via rotor chamber 68.

The main gallery 116 is positioned inwardly of the sub-gallery 118 (i.e. closer to the oil pump 64). The main gallery 116 communicates with a first main gallery hole 126. The first main gallery hole 126 is parallel to the first sub-gallery hole 120. The first main gallery hole 126 is formed in and also terminates in the enclosing member 108, and thus does not extend completely through the enclosing member 108. The enclosing member 108 is further formed with a second main gallery communication hole 128 which communicates with an inner portion of the first main gallery hole 126. The second main gallery hole 128 (shown diagrammatically in FIG. 6) is disposed so as to extend obliquely relative to the first main gallery hole 126 and opens into the chain chamber 106. The second hole 128 is formed as a threaded hole in order to mount therein a union bolt 132.

As shown in FIG. 8, the second cylinder block 4-2 is further provided with an oil filter 130. The oil filter 130 collects and then filters oil from the sub-gallery 118 before discharging the filtered oil into the main gallery 116.

The pipe connection 136, which is one end of an oil pipe 134, is disposed and capped on the union bolt 132.

In the illustrated embodiment, the union bolt 132 includes a generally axially extending passage therethrough (not shown), and also includes a generally radially extending passage (not shown) which communicates with the axial passage. These bolt passages thus permit oil to flow from the first main gallery hole 126 into the oil pipe 134.

The oil pipe 134, in the illustrated embodiment, is made of an iron material. The oil pipe 134 differs in coefficient of linear expansion from the enclosing member 108. Further, the oil pipe 134 is laid inside the chain chamber 106. The other end of the oil pipe 134 is connected to a pipe-connection member 140 (FIG. 4) that is mounted on the enclosing member 108 by means of connection-mounting bolts 138. The pipe-connecting member 140 is formed with an oil passageway 142 that communicates with the oil control valve 112.

The oil pipe 134 has a first bend 144-1, a second bend 144-2, and a third bend 144-3 sequentially formed at one end portion thereof on the side of the second cylinder block 4-2 in order to avoid interfering with the oil pump 64. The other end portion of the oil pipe 134 on the side of the cylinder head 6 is formed substantially linearly along the timing chain 100.

As shown in FIG. 4, the enclosing member 108 also defines a hydraulic communication passage 146, a spark delay passage 148, and a spark advancement passage 150 so as to guide oil from the oil control valve 112 into the hydraulic actuator 102.

The operation of the first embodiment will be described.

When the oil pump 64 is driven into operation, then oil in the oil pan 14 is drawn therefrom through the oil strainer 82 into the inlet port 70 and then the outlet port 72. The oil passes through the second sub-gallery communication hole 122, the first sub-gallery communication hole 120, and the sub-gallery 118 in this order before reaching the oil filter 130 as indicated by the arrows in FIGS. 5 and 6. The oil filter 130 removes impurities from the oil. Such cleaned oil is then fed into the main gallery 116. The oil is further driven through the first and second main gallery communication holes 126, 128 and the oil pipe 134, and is then delivered to the oil control valve 112. The cylinder block 4 is provided with a lubrication path from the main gallery 116 parallel to the oil pipe 134. The lubrication path provides lubrication to each section of the engine 2.

The oil control valve 112 is actuated by control means in accordance with conditions such as the number of engine revolutions, a degree of accelerator opening, temperature, and so on, so as to provide hydraulic pressure in the spark delay oil passage 148 and the spark advancement oil passage 150. The hydraulic actuator 102 is thereby operated to enable proper valve timing.

The oil passageway structure pursuant to the first embodiment enables introduction of oil from the lower portion of the cylinder block 4 into the cylinder head 6 without the need for changes in shape of the existing first and second cylinder blocks 4-1, 4-2. This feature obviates the need for modification of fabrication facilities and its attendant investment. Consequently, a reduced amount of plant investment is achievable.

Moreover, even if the oil leaks from mounting portions of the oil pipe 134 at either end thereof, then such seeping oil is trapped in the chain chamber 106. As a result, escape of the oil to the outside environment can be prevented.

Further, the oil pipe 134 formed with a plurality of bends 144 provides a greater degree of freedom in layout design, and further makes it possible to prevent the occurrence of cracks. More specifically, the conventional practice of providing respective oil holes in the cylinder block 4, the cylinder head 6, and the enclosing member 108 is subject to restrictions on directions in which the oil holes are machined. However, the use of the oil pipe 134 in accordance with the present embodiment allows for a greater level of freedom in layout design because it is only necessary to bend the oil pipe 134 to accommodate peripheral components. Further, the enclosing member 108 and the oil pipe 134 are formed of aluminum and iron, respectively, and these two elements differ in coefficient of thermal expansion from one another. Consequently, there occur differences between mounting pits when the engine 2 is heated to an elevated temperature. In this case, when a linear oil pipe is connected to the enclosing member 108, then cracks are likely to occur because stresses are concentrated on the peripheries of locations where brackets of the oil pipe or bosses of the enclosing member 108 are present. Pursuant to the present embodiment, however, the oil pipe 134 is formed with a plurality of bends 144, and the oil pipe 134 itself is thereby rendered flexible to absorb differential thermal expansion. As a result, the occurrence of the aforementioned cracks can be avoided.

Further, since the oil pipe 134 is mounted as one-piece on the enclosing member 108, then sub-assembly is possible to carry out. Then, when the cylinder block 4 and the cylinder head 6 are connected together via the enclosing member 108, such executable sub-assembly eliminates line operations in manufacturing processes after the cylinder block 4 and the cylinder head 6 are assembled together. As a result, improved efficiency of assembly can be realized.

Moreover, since the oil filtered through the oil filter 130 can be supplied to the oil control valve 112, then the oil control valve 112 is free of scoring, locking, and malfunctioning, all of which otherwise would result from foreign particles being present in the oil. This feature allows the oil control valve 112 to be maintained in a good condition.

Further, since the enclosing member 108 is defined with the first and second main gallery communication holes 126, 128 as well as the first and second sub-gallery communication holes 120, 122, then there fewer fabrication processes are necessary to drill the cylinder block 4. In addition, the cylinder block 4 can be made simpler in shape.

Figure 10:
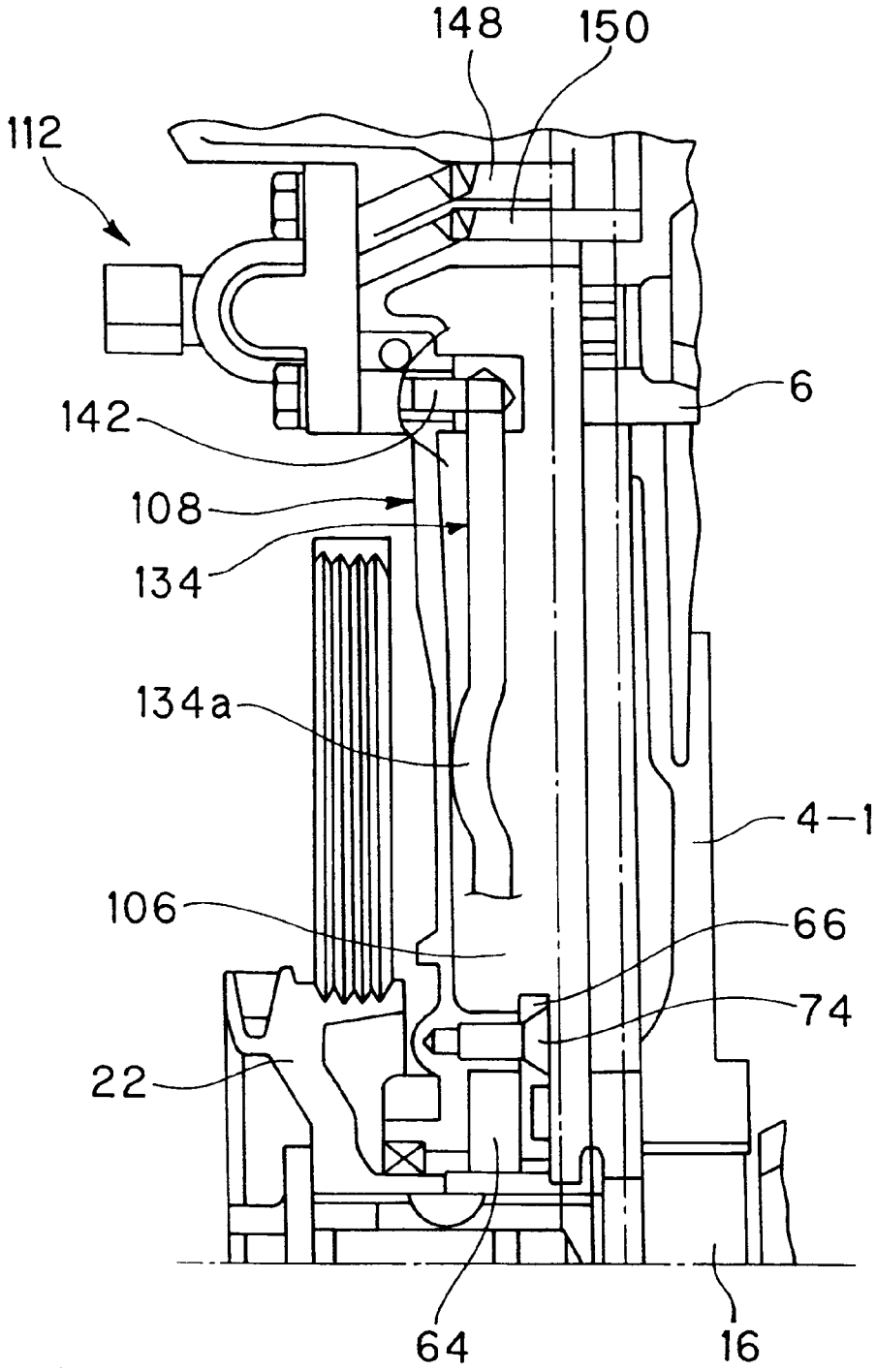
FIG. 10 illustrates a state in which an oil pipe is mounted in accordance with a second embodiment of the invention.
Figure 11:
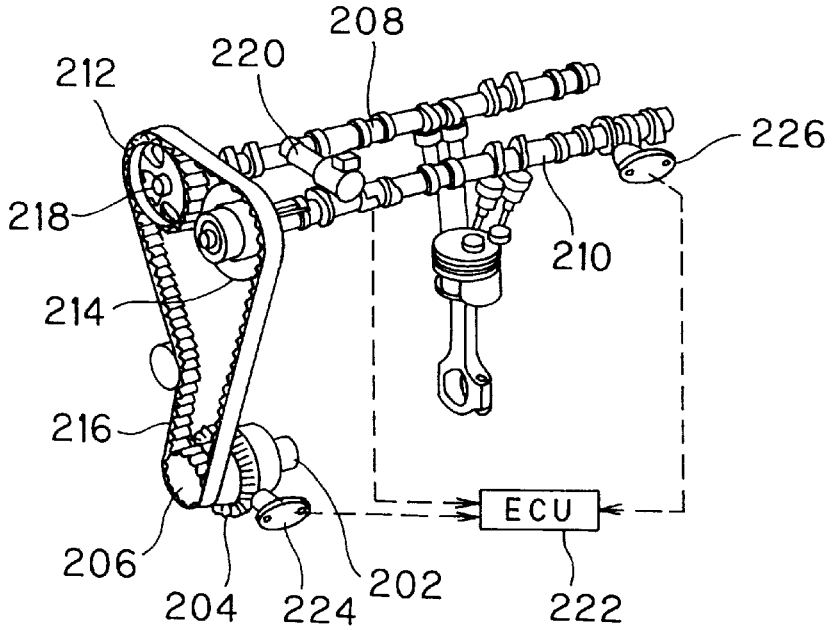
FIG. 11 (PRIOR ART)
FIG. 11 shows a conventional variable valve timing system.
Figure 12:
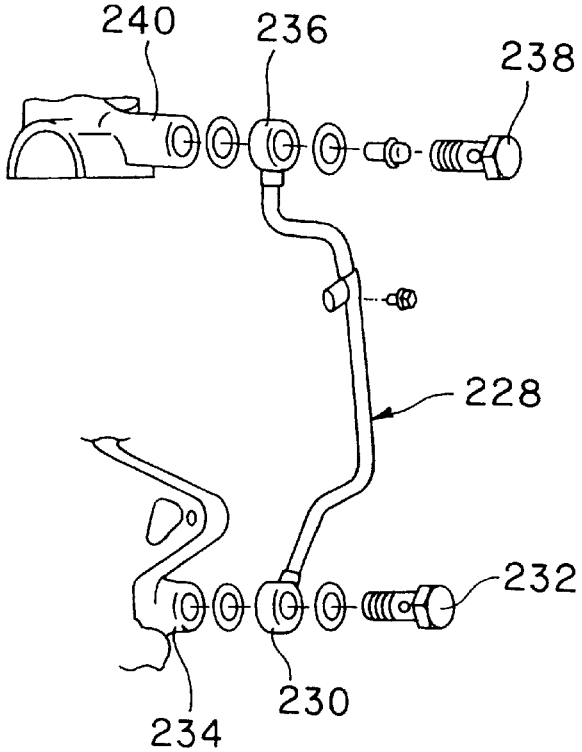
FIG. 12 (PRIOR ART)
FIG. 12 illustrates a state in which an external add-on oil pipe is mounted in a conventional manner.

FIG. 10 illustrates a second embodiment. In this embodiment, the same reference characters are utilized for features identical in function to those described above relative to the first embodiment.

The oil pipe 134 in accordance with the second embodiment is bent at a substantially intermediate portion thereof to form an abutment bend 134*a*. Further, the bend 134*a* is either held against or fixedly secured to an inner surface of an enclosing member 108.

The oil passageway structure according to this second embodiment provides effects similar to the above-described first embodiment. In addition, since a substantially intermediate portion of the oil pipe 134 is either in abutment with or rigidly fixed to the enclosing member 108, then the oil pipe 134 serves as a reinforcing rib which can reduce the occurrence of vibrations or noises from the enclosing member 108.

As evidenced by the above detailed description, pursuant to the present invention, the oil pipe is provided between a passageway on the downstream side of the oil pump and the oil control valve, in which the oil pipe is laid inside the chain chamber. Further, the oil pipe can be bent when necessary. As a result, a greater degree of freedom in design is achievable. In addition, there is no need to change respective shapes of the cylinder block and the cylinder head. Further, fabrication facilities are eliminated, with a consequential reduction in plant investment.

Moreover, oil leakage outside the engine is precluded, even if the oil escapes out of the mounting portions of the oil pipe at both ends thereof.

Further, since the oil pipe is mounted as one-piece on the enclosing member, then sub-assembly is executable, with an attendant improvement in the efficiency of assembly.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. An oil passageway structure for an internal combustion engine having a crankshaft rotatably supported on a cylinder block of the engine, a crankshaft timing sprocket positioned on the crankshaft, a camshaft disposed and rotatably carried on a cylinder head for opening and closing intake and exhaust valves, the cylinder head being disposed on the cylinder block, a camshaft sprocket positioned on the camshaft, a timing chain, disposed around the crankshaft timing sprocket and the camshaft sprocket, an enclosing member extending over the cylinder block and the cylinder head so as to cover the timing chain to form a chain chamber, an oil pump provided on a side of the cylinder block, an oil control valve disposed on a side of the cylinder head for actuating hydraulic equipment, whereby oil from the oil pump is introduced into the oil control valve, the oil passageway structure comprising: an oil pipe disposed between a passage located at a downstream side of the,oil pump and the oil control valve, the oil pipe being provided inside the chain chamber.

2. An oil passageway structure as defined in claim 1, wherein the oil pipe is mounted at both ends on the enclosing member.

3. An oil passageway structure as defined in claim 1, wherein the oil pipe is made of a material which differs in coefficient of thermal expansion from that of the enclosing member, and wherein the oil pipe has a plurality of bends.

4. An oil passageway structure as defined in claim 3, wherein the bends are formed at one part of the oil pipe on the side of the oil pump to avoid interfering with the oil pump, while another part of the oil pipe on the side of the oil control valve is formed substantially linearly along the timing chain.

5. An oil passageway structure for an internal combustion engine having a crankshaft rotatably supported on a cylinder block of the engine, a crankshaft timing sprocket positioned on the crankshaft, a camshaft disposed and rotatably carried on a cylinder head for opening and closing intake and exhaust valves, the cylinder head being disposed on the cylinder block, a camshaft sprocket positioned on the camshaft, a timing chain extending around the crankshaft timing sprocket and the camshaft sprocket, an enclosing member extending over the cylinder block and the cylinder head so as to cover the timing chain to form a chain chamber, an oil pump provided on a side of the cylinder block, an oil control valve disposed on a side of the cylinder head for actuating hydraulic equipment, whereby oil from the oil pump is introduced into the oil control valve, the oil passageway structure comprising: a main gallery and a sub-gallery both formed in a lower portion of the cylinder block, the main gallery extending in an axial direction of the crankshaft, the sub-gallery extending generally parallel to and being disposed outwardly from the main gallery; a sub-gallery communication hole and a main gallery communication hole both defined in the enclosing member, the sub-gallery communication hole providing communication between the sub-gallery and the oil pump, the main gallery communication hole communicating with the main gallery; a union bolt provided in a portion of the main gallery communication hole; and an oil pipe mounted on the union bolt and communicating with the main gallery communication hole for introducing oil to the oil control valve, the oil pipe being disposed within the chain chamber.

6. An oil passageway structure as defined in claim 5, wherein part of the oil pipe is in abutting contact with an inner surface of the enclosing member.

7. An oil passageway structure as defined in claim 5, wherein said sub-gallery communication hole has a first portion that extends generally in the axial direction of the crankshaft and a second portion which extends transversely with respect to the crankshaft and permits communication between said first portion and a discharge port of the oil pump.

8. An oil passageway structure as defined in claim 7, wherein said portion of said main gallery communication hole is a first portion thereof, and said main gallery communication hole has a second portion defining a longitudinal axis and extending between said main gallery and said first main gallery portion, said first main gallery portion defining a longitudinal axis transverse with respect to the axis of said second main gallery portion such that said first main gallery portion extends toward and open into said chain chamber.

9. An oil passageway structure as defined in claim 1, wherein part of the oil pipe is in abutting contact with an inner surface of the enclosing member.

10. An oil passageway structure as defined in claim 1, wherein a part of said oil pipe disposed adjacent said oil pump is bent outwardly and away from said oil pump to avoid interference therewith.

11. An oil passageway structure for an internal combustion engine having a crankshaft rotatably supported on a cylinder block, a crankshaft timing sprocket mounted on the crankshaft, a cylinder head mounted on the cylinder block and a camshaft rotatably mounted on the cylinder head for opening and closing intake and exhaust valves, a camshaft sprocket mounted on the camshaft, a timing chain extending about the crankshaft timing sprocket and the camshaft sprocket, a cover member extending over the cylinder block and the cylinder head and therewith defining a chamber in which the timing chain is disposed, an oil pump mounted on the cylinder block and an oil control valve mounted on the cylinder head, said oil passageway structure comprising: a main gallery and a sub-gallery each defined in a lower portion of the cylinder block and each extending in an axial direction defined by the crankshaft; a main gallery hole which communicates with the main gallery and a sub-gallery hole which communicates with the sub-gallery and permits oil flow from the oil pump thereinto, each said main gallery hole and said sub-gallery hole being defined within the cover member; and an oil pipe mounted on the cover member and communicating with the main gallery hole to permit oil flow from the main gallery hole to the oil control valve.

12. An oil passageway structure as defined in claim 11 wherein said sub-gallery is disposed to direct oil flow from said sub-gallery hole into an oil filter prior to the oil entering said main gallery and said main gallery hole.

13. An oil passageway structure as defined in claim 12 wherein a lower end of said oil pipe is mounted on a union bolt disposed within the sub-gallery hole and an upper end of said oil pipe is mounted adjacent an upper portion of said cover member for communication with the oil control valve.

* * * * *